US007627976B1

(12) United States Patent
Olson

(10) Patent No.: US 7,627,976 B1
(45) Date of Patent: Dec. 8, 2009

(54) FIBER OPTIC SIGHT FOR FIREARMS WITH NIGHTTIME CAPABILITIES

(75) Inventor: Douglas D. Olson, Huntsville, AR (US)

(73) Assignee: Wilsons Gunshop, Inc, Berryville, AR (US)

( * ) Notice: Subject to any disclaimer, the term of this patent is extended or adjusted under 35 U.S.C. 154(b) by 51 days.

(21) Appl. No.: 12/006,031

(22) Filed: Dec. 31, 2007

(51) Int. Cl.
*F41G 1/32* (2006.01)

(52) U.S. Cl. ..... 42/145; 42/132; 42/141

(58) Field of Classification Search ..... 42/132, 42/141, 144, 145
See application file for complete search history.

(56) References Cited

U.S. PATENT DOCUMENTS

| | | | | | |
|---|---|---|---|---|---|
| 3,362,074 | A | * | 1/1968 | Luebkeman et al. | 42/144 |
| 3,994,597 | A | * | 11/1976 | Calder et al. | 356/251 |
| 4,494,327 | A | * | 1/1985 | Cullity | 42/132 |
| RE35,347 | E | * | 10/1996 | Bindon | 42/145 |
| 6,216,351 | B1 | | 4/2001 | Flubacher et al. | |
| 6,233,826 | B1 | | 5/2001 | Uhlmann et al. | |
| 6,581,317 | B1 | | 6/2003 | Slates | |
| 2007/0107292 | A1 | | 5/2007 | Bar-Yona et al. | |

FOREIGN PATENT DOCUMENTS

| | | | |
|---|---|---|---|
| EP | 470 016 | * | 2/1992 |

* cited by examiner

*Primary Examiner*—Stephen M Johnson

(57) ABSTRACT

New and unique improvements of prior known fiber optic sights for firearms with day and night time capabilities are disclosed that comprise (A) a sight base, (B) a fiber optic rod mounted in said base having an angle cut at the distal end which is positioned on the underside of the rod, and (C) an artificial light insert that is positioned in a cavity in the fiber optic rod. The cavity is sealed with a fiber optic rod plug and epoxied using an optically clear epoxy. The sight provides increased light output, co-located day and night sight views with increased illumination during the day, and uses a low power tritium insert for night time use. At night the sight achieves a transition from a bright ring during the day to a small central dot at night while maintaining the same color light for both.

15 Claims, 2 Drawing Sheets

FIBER OPTIC SIGHT FOR FIREARMS WITH NIGHTTIME CAPABILITIES

BACKGROUND OF THE INVENTION

1. Field of the Invention

This application relates broadly to a fiber optic sight for firearms. More particularly, it concerns an improved form of a fiber optic sight with nighttime capabilities for use with firearms, including handguns and long arms.

2. Description of the Prior Art

Co-pending U.S. patent application Ser. No. 11/899,069 filed Sep. 5, 2007, "Fiber Optic Sight for Firearms", is hereinto incorporated as a reference for this current application. There are many fiber optic sights available which utilize tritium inserts for illumination during nighttime operations but there are a number of problems with such sights. Generally there have been four methods of dealing with the light emitted from a tritium night insert. The first is to put the tritium insert at the distal end of the fiber in which case the light emitted from the tritium vial must travel thru the full length of the fiber. An example of this method is disclosed in U.S. 2007/0107292 (Bar Yona et al). The second method is to put the tritium so it shines onto the outside surface of the fiber optic rod from which some percentage is absorbed by the rod and transmitted to the shooters eye. An example of this method is disclosed in U.S. Pat. No. 6,581,317 (Slates). The third method is to position a tritium insert adjacent to the fiber optic where it is not co-located with the fiber optic rod. This method is disclosed in U.S. Pat. No. 6,216,351 (Flubacher, et al). The fourth method is to have the tritium insert inserted into a fiber optic rod from the front and to have the output face of the tritium insert coplanar with the face of the fiber optic rod. This method is disclosed in U.S. Pat. No. 6,233,836 (Uhlmann et al). As a result, the manufacturers of sights of types one and two typically end up using tritium inserts that have higher output power (more radiation) than do sights of types three and four with direct viewing of the tritium insert. Obviously, what is desired is a sight with co-located day and night light viewing in a shorter, brighter package that still utilizes lower power tritium inserts (less radiation) and also minimizes sight length so to maximize the distance between the front and rear sight for improved accuracy.

The present invention solves these issues by providing a fiber optic sight that provides for co-located day and night sight views with increased illumination during the day, uses a low power tritium insert for night time use and packages it all in a relatively small volume. This is achieved by placing a tritium insert into a cavity within a fiber optic rod that is angled at its forward end which allows ambient light from the exterior of the rod opposite the angled cut to reflect off the angled cut toward the shooters eyes. At night the tritium insert has enough length of fiber optic rod to shine thru to achieve a nice transition from bright ring during the day to a small central dot at night while maintaining the same color light for both. The single flat proximal surface of the rod is easy to keep clean and the tritium insert can still be of low radiation. An optical grade epoxy optically couples the tritium insert output lens to the fiber optic rod so to minimize light loss from the tritium insert into the fiber optic rod.

OBJECTS

A principal object of the invention is to co-locate the light coming from the fiber optic rod during the day with that provided at night from the tritium insert. The fiber optic rod is manufactured with the cavity for the tritium insert which is kept concentric with the rods outside diameter. The cavity enters the fiber optic rod from the distal (forward), angled surface and ends approximately 0.050 from the rear face of the rod. The presence of the tritium insert, being concentric with the fiber optic rod, blocks most of the light being reflected down the fiber optic rod except for that light that passes around the tritium insert. This means that the shooter sees a ring of light at the rear end of each optical fiber assembly during the day. As a consequence the shooter sees a ring of light at each optical fiber assembly during the day. As day transitions into night the light output from the tritium insert is seen at the center of the fiber which augments the decreasing brightness of the ring of light from the twilight. At night the shooter just sees the round output glow from the tritium insert which is approximately the same diameter as the inside of the ring of light seen during the day. The shooter had no need to change anything about his aim of the firearm as the transition from day to night occurs.

A further object is to provide the shooter with a sighting system that results in increased illumination being directed towards the shooter's eyes during the day. The sight achieves this through the use of an angled cut at the forward end of the fiber optic rod. The cavity for the tritium insert enters the rod from the angled surface so after the tritium insert is epoxied into place, a plug of the same fiber rod is inserted and also epoxied into place utilizing an optically clear epoxy. The angled surface is positioned in a sight base which secures the rod with the angled surface on the bottom of the rod and exposes the top portion of the rod to external ambient light. The angled cut can be polished and acts as a mirror surface that effectively redirects the light striking the exposed surface of the rod, which travels thru the rod then reflects off the polished angled surface back along the long axis of the fiber rod toward the shooters eyes. The tritium insert does not transmit light shined unto its distal end since it is normally sealed with an optically opaque material in order to increase light output from the viewing lens during nighttime operations. Thus during the day the shooter will see a bright ring of light which surrounds the darker tritium insert. Additionally, a reflective coating or mirrored material can be applied directly to, mated or bonded to the polished angled surface to improve the reflectivity of the polished angled surface and further enhance the redirection of light striking the exposed portion of the fiber rod back along the long axis of the fiber toward the shooters eyes. The angled surface can be hidden from view forward of the sight by positioning the rod below the top surface of the holder. Adding a reflective coating or mirrored material to the angled surface also blocks any light from being reflected forward of the angled surface which could expose the shooters location.

A further object is to provide a sighting system fully capable of operations at night. The addition of a tritium insert is obviously the best way to accomplish this because the tritium has a long service life without the need for batteries. Because tritium is radioactive, it is best to use the smallest level of radioactivity in the insert that still meets the user's needs. By placing the tritium insert in the fiber optic rod, the remaining length of fiber optic rod that the tritium must shine thru is minimized. In so doing, very little light output from the tritium insert is lost, allowing the use of a lower level of radioactivity insert than is possible with a tritium insert mounted at the distal end of the fiber optic rod. The use of green fiber optic rods is the best choice as it passes the greatest percentage of the green light issuing from the tritium insert. This same system can also be used with light sources other than tritium inserts. For instance a small light emitting diode (LED) can be substituted for the tritium insert. The leads would exit thru the front angled surface and connect to a battery source within the sight base. The results would be the same in that you would have a ring of light during the day and a point in the center of the ring during night time operations.

A further object is to minimize the length of the sight while maintaining the brightness of the sight during both day and night operations. The sight in accordance with this invention allows for a very short package. There is approximately 0.050 inch of fiber optic rod in front of the approximately 0.250 inch long tritium insert followed by an angled surface approximately 0.120 inch long. Thus the total length of the tritium enhanced fiber optic rod assembly is 0.42 inches. The resulting front sight is only 0.545 inches long when the standard front sight is 0.455 inches long. Thus the front sight grew in length by only 0.090 inches in order to add the night operations capability. This is far less than the effect of adding the tritium insert to the distal end of the fiber optic rod. While having the tritium insert coplanar with the front face of the fiber optic rod would result in a 0.050 inch shorter package length, in so doing the transition from day to night would not result in as good of blending of the twilight glow with that of glow from the tritium insert that occurs within a single fiber.

Other objects and further scope of applicability of the present invention will become apparent from the detailed descriptions given herein; it should be understood however, that the detailed descriptions, while an indication of preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of unique improvements to a fiber optic sight with night use capabilities comprising:

(a) a fiber optic sight that co-locates the light from the fiber optic during both daytime and nighttime usage. During the day, light is allowed to shine onto the outside diameter of the fiber optic rod. That light passes thru the rod and strikes the front angled surface of the rod and is reflected back along the long axis of the rod toward the shooters eyes. The tritium insert blocks part of the light coming rearward from the angled surface so the shooter sees a ring of bright light surrounding the darker tritium insert. As day transitions into night the reflected light from the angled surface decreases until at full dark just the light emitted from the tritium insert is visible centered in what was the ring of light during the day.

(b) a fiber optic sight with nighttime sighting capability which allows for increased illumination to the shooter's eyes when used in daytime conditions by the use of an angled cut at the forward end of each of the three fiber optic rods, the angled cut being placed on the underside of each rod, and whereby all of the fiber optic rods are exposed to the ambient light through the exterior surface of the rod onto their individual angled cut. Since the imbedded tritium insert is positioned in the center of each fiber, the light is projected towards the shooter's eye from each fiber is in the form of a bright ring. The outside diameter of each light ring is the outside diameter of the rod and the inside diameter of each light ring is the outside diameter of the tritium insert. Because the level of illumination is enhanced, the ring of light is quite bright and easily performs the function of being one of the three aiming points.

(c) a fiber optic sight with nighttime sighting capability that further increases the daytime illumination to the shooter's eyes by polishing the angled cut and/or providing a reflective surface applied to, bonded to, or positioned adjacent to the angled cut.

(d) a fiber optic sight with nighttime sighting capability that allows for increased daytime illumination but at the same time uses a much shorter length of fiber optic rod than previous sights.

(e) a fiber optic sight with nighttime sighting capability which still provides increased illumination to the shooters eyes while protecting the tritium insert and fiber rod from shock and impact by mounting the assembly in a holder which only exposes the fiber rod to light from above the top of the rod. The tritium insert is additionally protected from shock because the fiber optic rod itself will help reduce the shock transmitted thru its thermoplastic material.

The first unique improvement is the use of an angled cut at the front end of the fiber optic rod which houses the tritium vial. The angled cut is placed in the sight base so it is on the underside of the rod. The angled surface acts as a mirror which redirects light which strikes the external surface of the rod, travels thru the rod, strikes the angled surface and is then reflected back along the long axis of the rod toward the shooters eyes. Even though the tritium vial blocks some of the reflected light, the angled surface dramatically increases the amount of light directed towards the shooter's eyes but at the same time prevents light going forward, towards the target, by allowing the blocking of the end of the rod from the light.

A second unique improvement is achieved by the use of polishing the angled cut and/or forming a reflective surface on or placing a reflective surface against the angled cut. Polishing the angled surface alone enhances the reflectivity of the surface and enhances the amount of illumination directed toward the shooters eyes. The polished angled surface can also be mated to a reflective surface which further enhances the amount of illumination to the shooter's eyes. Bonding a reflective surface to the polished angled surface with an optically clear bonding agent provides nearly equal reflectivity to forming a reflective surface directly onto the polished angled surface.

A third unique improvement is the resulting decrease in length of the fiber optic rod because of the increased illumination. Until now, the fiber optic rod has been rather long and required a lot of its exterior surface to be exposed to light in order to provide sufficient illumination directed toward the shooters eyes. In those cases where the tritium vial is added to the distal end of the fiber optic rod, the total sight length is increased by the approximately 0.250 length of the tritium vial. By locating the tritium vial within the rod but only approximately 0.050 from its front surface the overall length of this fiber optic assembly is only 0.42 inch. This is still considerably shorter than most fiber optic sights alone.

A fourth unique improvement is the ability to adequately protect the fiber optic rod and its enclosed tritium vial from damage due to external shock by allowing the short optical fiber assembly to be set into a pocket within the sight which provides side and bottom protection for the fiber. Even with the relatively small amount of surface being exposed to illumination from ambient light, the amount of light directed toward the shooters eyes is still increased.

The final unique improvement is the capability to use an artificial light source in conjunction with the fiber optic sight. By correct positioning of the artificial light source, the light may be directed directly toward the proximal end of the fiber. Minimizing the length of fiber optic rod that the artificial light source must penetrate allows it to be of lower power yet still provide sufficient illumination capabilities of the fiber optic sight.

BRIEF DESCRIPTION OF THE DRAWINGS

A more complete understanding of the invention can be obtained by reference to the accompanying drawings wherein.

DESCRIPTION OF PREFERRED EMBODIMENTS

Figure 1:
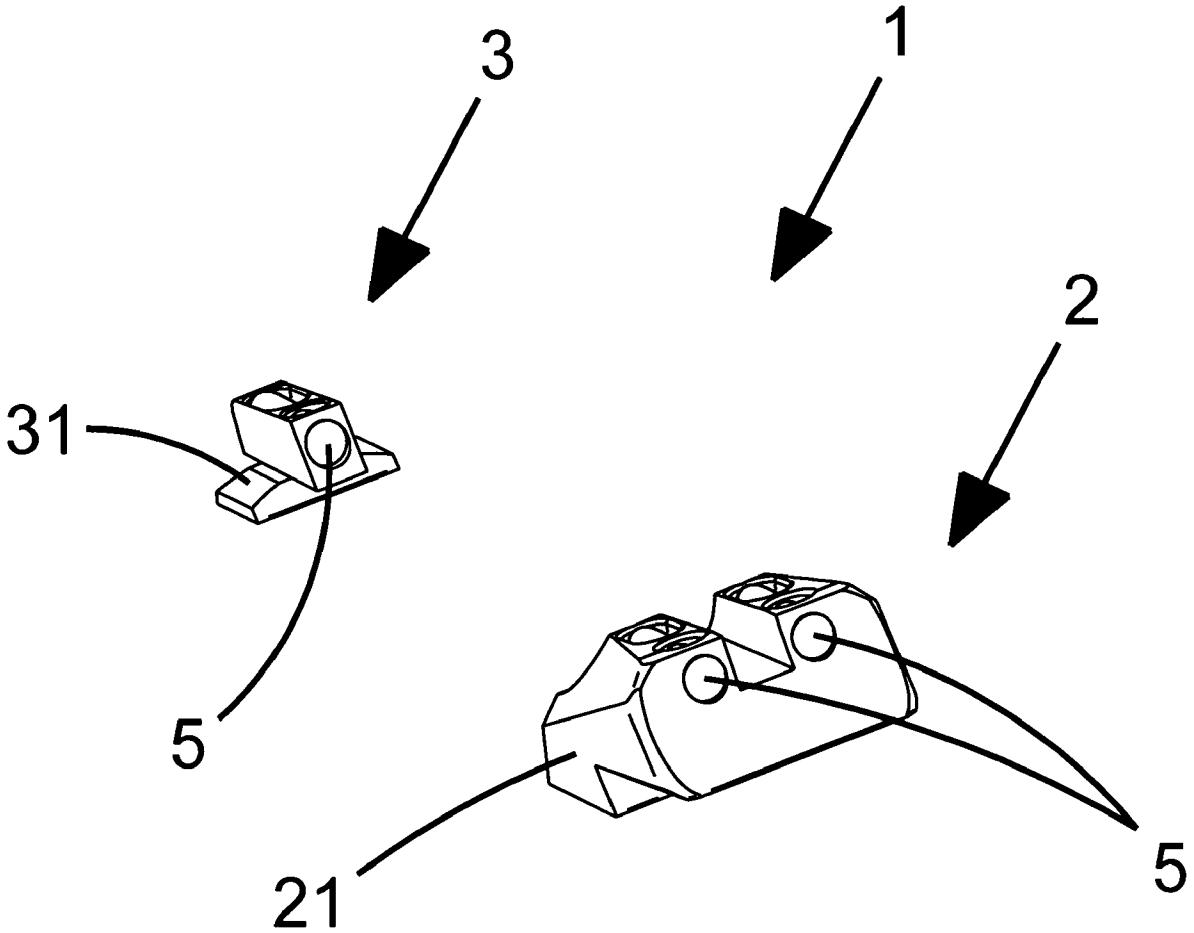
FIG. 1 is an isometric view of a typical set of fiber optic sights.

Referring in detail to FIG. 1 of the drawings, the fiber optic sight set with nighttime sighting capability 1 consists of a fiber optic rear sight assembly with nighttime sighting capability 2 and a fiber optic front sight assembly with nighttime sighting capability 3. The fiber optic rear sight assembly with nighttime sighting capability 2 contains sight base 21 and two fiber optic rod assemblies 5. The fiber optic front sight assembly with nighttime sighting capability 3 contains front sight base 31 and one fiber optic rod assembly. All three of the fiber optic rod assemblies 5 are bonded to rear sight base 21 and front sight base 31 using an optically clear adhesive (not shown).

Figure 2:
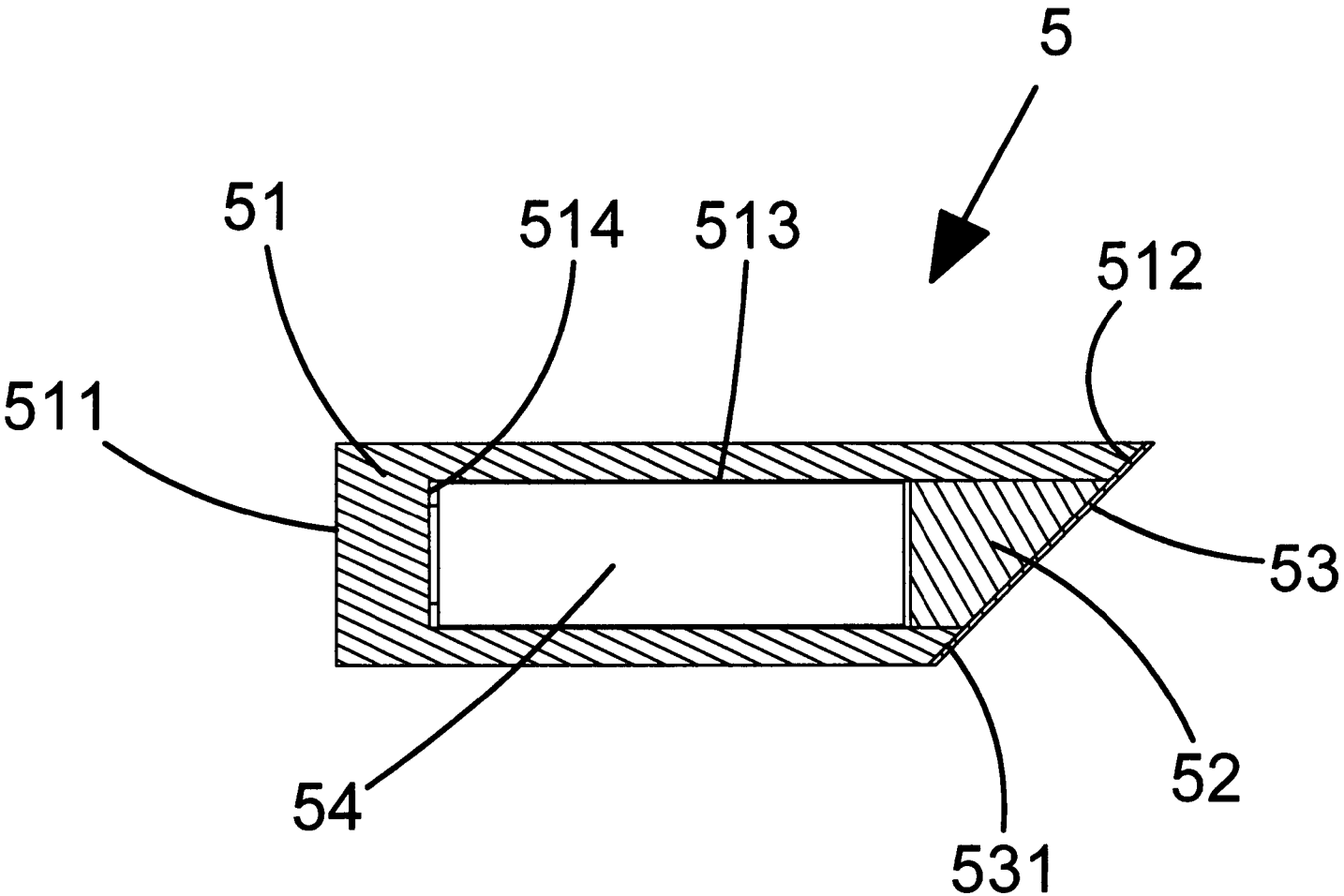
FIG. 2 is a sectional view of the fiber optic rod assembly which has nighttime sighting capability.

Referring in detail to FIG. 2 of the drawings, the fiber optic rod assembly 5 has a fiber optic rod 51, a front plug 52, a reflector 53 and tritium insert 54 all of which are bonded into a single unit utilizing an optically clear adhesive (not shown). Fiber optic rod 51 has a rear face 511, a slanted front face 512 and an internal cavity 513 with rear face 514. Reflector 53 has reflective face 531 which is bonded to angled face 512 and acts to reflect light striking it from above back along the long axis of fiber optic rod 51.

As shown in FIGS. 1 and 2, the rear sight assembly 2 uses two fiber optic rods 51 mounted in the sight base 2. The distal ends of the rods have tapered surfaces 512 and these tapered surfaces abut two reflectors 53 while the proximal ends of the rods terminate in rear apertures. The fiber optic rod assemblies 5 are exposed to the ambient light through the outside surfaces of the optic rod and the ambient light travels through the rods. It is reflected down the fiber optic rods 51 by the reflectors 53 of the fiber optic rods and the reflective surfaces 531 of the reflectors 53. No light is directed away from the shooter towards a target due to the positioning of the fiber optic rods 51 in the sight base 21 and the reflector 53. The forward travel of light is blocked by the sight base 2 and reflector 53. The angled surface is hidden from view by the positioning of the fiber optic rod below the upper surface of the sight base. This minimizes the potential for the target to become aware of the shooter due to an increase in light as could be the case if the slanted front face 512 of the fiber optic rods were exposed to the target.

While FIG. 2 shows a reflector 53 that consists of a reflective face 531 which is bonded to the angled face 512, in an alternate embodiment the reflector 53 may be replaced with a polished or reflective face that has no coating that is bonded to the slanted front face 512. The polished or reflective face replaces the reflector 53 that is used with the embodiment shown in FIG. 2 and performs the same function as the reflector 53.

Regardless of the different embodiments used on the front face of the fiber optic rod, the tritium insert 54 is positioned in the internal cavity 513, and during low light or darkness, the light emitted from the tritium insert provides a visible dot to the shooter. In another embodiment, to enhance the illumination available to the shooter, the sight may utilize an artificial light source such as an LED (Light Emitting Diode) in place of the tritium insert. In such an embodiment, the LED is positioned in the internal cavity 513, and the leads from the LED would pass through the front plug 52 and connect to a small battery positioned within the sight base.

While the invention has been shown and described with reference to a certain specific preferred embodiment, modification may now suggest itself to those skilled in the art. Such modifications and various changes in form and detail may be made herein without departing from the spirit and scope of the invention. Accordingly, it is understood that the invention will be limited only by the appended claims.

The invention claimed is:

1. A fiber optic sighting device for use in ambient light and in darkness and comprising:

(a) a sight base;

(b) a fiber optic rod mounted in said sight base and having a proximal end and a distal end, wherein said distal end is cut at an angle to the longitudinal axis of said fiber optic rod, wherein said angled cut is positioned on the underside of the rod; and (c) a concentric cavity positioned in said fiber optic rod, wherein said concentric cavity is filled with a light source, said concentric cavity being sealed by a plug of fiber optic rod, and wherein said fiber optic rod is exposed to said ambient light, wherein said ambient light is directed through said fiber optic rod onto said angled cut; and whereby said ambient light is reflected along the major axis of said fiber optic rod, whereby said light source blocks said ambient light being reflected along said major axis of said fiber optic rod, excepting said ambient light being reflected around said light source and whereby said reflected light is then emitted from said proximal end of said fiber optic rod as a ring of light, and (d) in the absence of ambient light and in darkness, said light source directs light along the major axis of the rod directly toward its proximal end.

2. The fiber optic sighting device according to claim 1, wherein said light source may be either a light emitting diode, or a radio-luminescent light source, or a chemo-fluorescent light source, or a phosphorescent light source.

3. The fiber optic sighting device according to claim 2, wherein said angled cut is polished to improve its reflectivity.

4. The fiber optic sighting device according to claim 2, wherein a reflector is positioned against said angled cut.

5. The fiber optic sighting device according to claim 2, wherein said fiber optic rod has a reflective coating applied directly to, mated to, or mated and bonded to the angled cut, and wherein said reflective coating is positioned directly against the angled cut.

6. The fiber optic sighting device according to claim 5, wherein said reflective coating is a reflective material that can be applied directly to, mated to, mated and bonded, or directly formed onto the angled cut.

7. A fiber optic sighting device for use in ambient light and in darkness and comprising:

(a) a sight base;

(b) a fiber optic rod mounted in said sight base and having a proximal end and a distal end, wherein said distal end is cut at an angle to the longitudinal axis of said fiber optic rod, wherein said angled cut is positioned on the underside of the rod;

(c) a concentric cavity positioned in said fiber optic rod, said concentric cavity being positioned at said distal end of said fiber optic rod;

(c) an artificial light source, said light source being positioned within said concentric cavity in said fiber optic rod, said concentric cavity being sealed by a plug of fiber optic rod, said plug having an angle being the same as said angle at said distal end of said fiber optic rod, and (d) a reflector, wherein said fiber optic rod is exposed to the ambient light, wherein said ambient light is directed through said fiber optic rod onto said angled cut and said reflector, and whereby said ambient light is reflected along the major axis of said fiber optic rod, whereby said artificial light source blocks said ambient light being reflected along said major axis of said fiber optic rod, excepting said ambient light being reflected around said artificial light source and whereby said reflected light is then emitted from said proximal end of said fiber optic rod as a ring of light, and (e) in the absence of ambient light and in darkness, said artificial light source directs light onto said fiber optic rod and directly toward its proximal end.

8. The fiber optic sighting device according to claim 7, wherein said light source may be either a light emitting diode, or a radio-luminescent light source, or a chemo-fluorescent light source, or a phosphorescent light source.

9. The fiber optic sighting device according to claim 8, wherein said angled cut is polished to improve its reflectivity and the optical coupling to the reflector.

10. The fiber optic sighting device according to claim 8, wherein the reflector is bonded to the fiber optic rod to improve the optical coupling between the angled surface and the reflector.

11. The fiber optic sighting device according to claim 10, wherein said reflective coating is a reflective material that can be applied directly to, mated to, mated and bonded, or directly formed onto the angled cut.

12. A fiber optic sighting device for use in ambient light and in darkness and comprising:

(a) a sight base with integral angled reflective surface;

(b) a fiber optic rod mounted in said sight base and having a proximal end and a distal end, wherein said distal end is cut at an angle to the longitudinal axis of said fiber optic rod, wherein said angled cut is positioned on the underside of the rod;

(c) a concentric cavity positioned in said fiber optic rod, said concentric cavity being positioned at said distal end of said fiber optic rod;

(c) an artificial light source, said light source being positioned within said concentric cavity in said fiber optic rod, said cavity being sealed by a plug of fiber optic rod, said plug having an angle being the same as said angle at said distal end of said fiber optic rod, and said fiber optic rod being positioned against said integral angled reflective surface; such that;

(d) when exposed to the ambient light, said ambient light is directed through said fiber optic rod onto said angled cut and said integral angled reflective surface, and whereby said ambient light is reflected along the major axis of said fiber optic rod, whereby said artificial light source blocks said ambient light being reflected along said major axis of said fiber optic rod, excepting said ambient light being reflected around said artificial light source and whereby said reflected light is then emitted from said proximal end of said fiber optic rod as a ring of light, and (e) in the absence of ambient light and in darkness, said artificial light source directs light onto said fiber optic rod directly toward said proximal end of said fiber optic rod.

13. The fiber optic sighting device according to claim 12, wherein said light source may be either a light emitting diode, or a radio-luminescent light source, or a chemo-fluorescent light source, or a phosphorescent light source.

14. The fiber optic sighting device according to claim 13, wherein said angled surface of said fiber optic rod is bonded to said integral reflective angled surface of said sight base to improve the optical coupling.

15. The fiber optic sighting device according to claim 13, wherein said angled cut on said fiber optic rod is polished to improve its reflectivity.

* * * * *